US008918939B1

(12) United States Patent
Morris et al.

(10) Patent No.: US 8,918,939 B1
(45) Date of Patent: Dec. 30, 2014

(54) OPERABLE RAMP

(71) Applicants: Donald Morris, Littleton, CO (US); David Johnson, Modesto, CA (US)

(72) Inventors: Donald Morris, Littleton, CO (US); David Johnson, Modesto, CA (US)

(73) Assignee: Lift-U, Division of Hogan, Mfg., Inc., Escalon, CA (US)

( * ) Notice: Subject to any disclaimer, the term of this patent is extended or adjusted under 35 U.S.C. 154(b) by 0 days.

(21) Appl. No.: 14/302,752

(22) Filed: Jun. 12, 2014

(51) Int. Cl.
*B65G 69/28* (2006.01)
*B66B 9/02* (2006.01)
*E04F 11/00* (2006.01)

(52) U.S. Cl.
CPC ..... *E04F 11/002* (2013.01); *E04F 2011/005* (2013.01); *Y10S 414/134* (2013.01)
USPC ..... 14/71.3; 14/71.1; 187/200; 414/921

(58) Field of Classification Search
USPC ..... 14/71.1, 71.3; 414/921; 187/200
See application file for complete search history.

(56) References Cited

U.S. PATENT DOCUMENTS

| | | | | |
|---|---|---|---|---|
| 8,631,529 | B1 * | 1/2014 | Johnson et al. | 14/71.3 |
| 8,739,342 | B1 * | 6/2014 | Johnson et al. | 14/71.3 |
| 8,813,290 | B1 * | 8/2014 | Morris | 14/71.3 |
| 2014/0131139 | A1 * | 5/2014 | Kitchin et al. | 187/200 |

* cited by examiner

*Primary Examiner* — Gary Hartmann
(74) *Attorney, Agent, or Firm* — Christensen O'Connor Johnson Kindness PLLC

(57) ABSTRACT

An operable ramp is moveable between a lowered stowed position and a raised deployed position. The operable ramp has a ramp panel rotatable about a first axis located at a first end. A support element is slidingly coupled to the ramp panel. The operable ramp further includes a drive assembly comprising an endless loop coupled to an end of the support element. The endless loop has a linear portion and an arcuate portion. During a first phase of deployment, the end of the support element moves upward along the linear portion. During a second phase of deployment, the end of the support element moves along the arcuate portion of the endless loop.

11 Claims, 16 Drawing Sheets

OPERABLE RAMP

BACKGROUND

The Americans with Disabilities Act (ADA) requires the removal of physical obstacles to those who are physically challenged. The stated objective of this legislation has increased public awareness and concern over the requirements of the physically challenged. Consequentially, there has been more emphasis on providing systems that enable physically challenged people to access buildings and other architectural structures that have a step at the point of ingress or egress.

Installing a fixed ramp is a common way to provide the physically challenged with access to a building with one or more steps at the entrance. Fixed ramps take up a large amount of space and often detract from the aesthetic qualities of the building. Fold out ramps similar to those used in vehicles can be utilized, but deployment often requires a large area into which the ramps deploy. Accordingly, there is a need for a ramp that provides access to a building with a step at the entrance, while minimizing the space required by the ramp.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A first embodiment of an operable ramp is moveable between a lowered stowed position and a raised deployed position. The operable ramp has a ramp panel rotatable about a first axis located at a first end. A support element is slidingly coupled to the ramp panel. The operable ramp further includes a drive assembly comprising an endless loop coupled to an end of the support element. The endless loop has a linear portion and an arcuate portion. During a first phase of deployment, the end of the support element moves upward along the linear portion. During a second phase of deployment, the end of the support element moves along the arcuate portion of the endless loop.

A second embodiment of a disclosed operable ramp is moveable between a lowered stowed position and a raised deployed position. The operable ramp includes a ramp panel rotatable about a first axis located at a first end of the ramp panel. A support element is slidingly coupled to the ramp panel, and a drive assembly is coupled to the support element to selectively raise one end of the support element. Raising one end of the support element rotates the ramp panel about the first axis and moves the support element in a first direction relative to the ramp panel. The operable ramp further includes a side curb slidingly coupled to the ramp panel and operatively coupled to the support element. Movement of the support element in the first direction relative to the ramp panel moves the side curb upward relative to the ramp panel.

A third embodiment of a disclosed operable ramp is moveable between a lowered stowed position and a raised deployed position. The operable ramp includes a ramp panel rotatable about a first axis located at a first end. The operable ramp further includes a support element slidingly coupled to the ramp panel. A side curb is operatively coupled to the support element so that movement of the support element in the first direction relative to the ramp panel moves the side curb upward relative to the ramp panel. The operable ramp also includes a drive assembly coupled to the support element to selectively drive the operable ramp through a deployment motion. During a first phase of the deployment, the drive assembly rotates the ramp panel about the first axis. During a second phase of the deployment, the side curb moves the support element relative to the ramp panel.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Exemplary embodiments of the presently disclosed operable ramp will now be described with reference to the accompanying drawings, where like numerals correspond to like elements. Exemplary embodiments of the disclosed subject matter are directed to operable ramps, and more specifically, to operable ramps that are selectively moveable between a stowed "step" position and a deployed "ramp" position. In particular, several embodiments of the present invention are directed to operable ramps for use in architectural settings such as building entrances in which the indoor and outdoor levels differ, for example, when the building entrance includes a step.

The following discussion proceeds with reference to examples of operable ramps suitable for use at building entrances wherein there is a change in elevation, i.e., a step up or step down. While the examples provided herein have been described with reference to their association with building entrances, it will be apparent to one skilled in the art that this is done for illustrative purposes and should not be construed as limiting the scope of the disclosed subject matter. Thus, it will be apparent to one skilled in the art that aspects of the disclosed operable ramp may be employed in a number of architectural settings, wherein a change in elevation, such as a step, provides an obstruction to a person with limited mobility.

The following detailed description may use illustrative terms such as higher, lower, inner, outer, vertical, horizontal, front, rear, proximal, distal, etc.; however, these terms are descriptive in nature and should not be construed as limiting. Further, it will be appreciated that embodiments of the disclosed subject matter may employ any combination of features.

Figure 1:
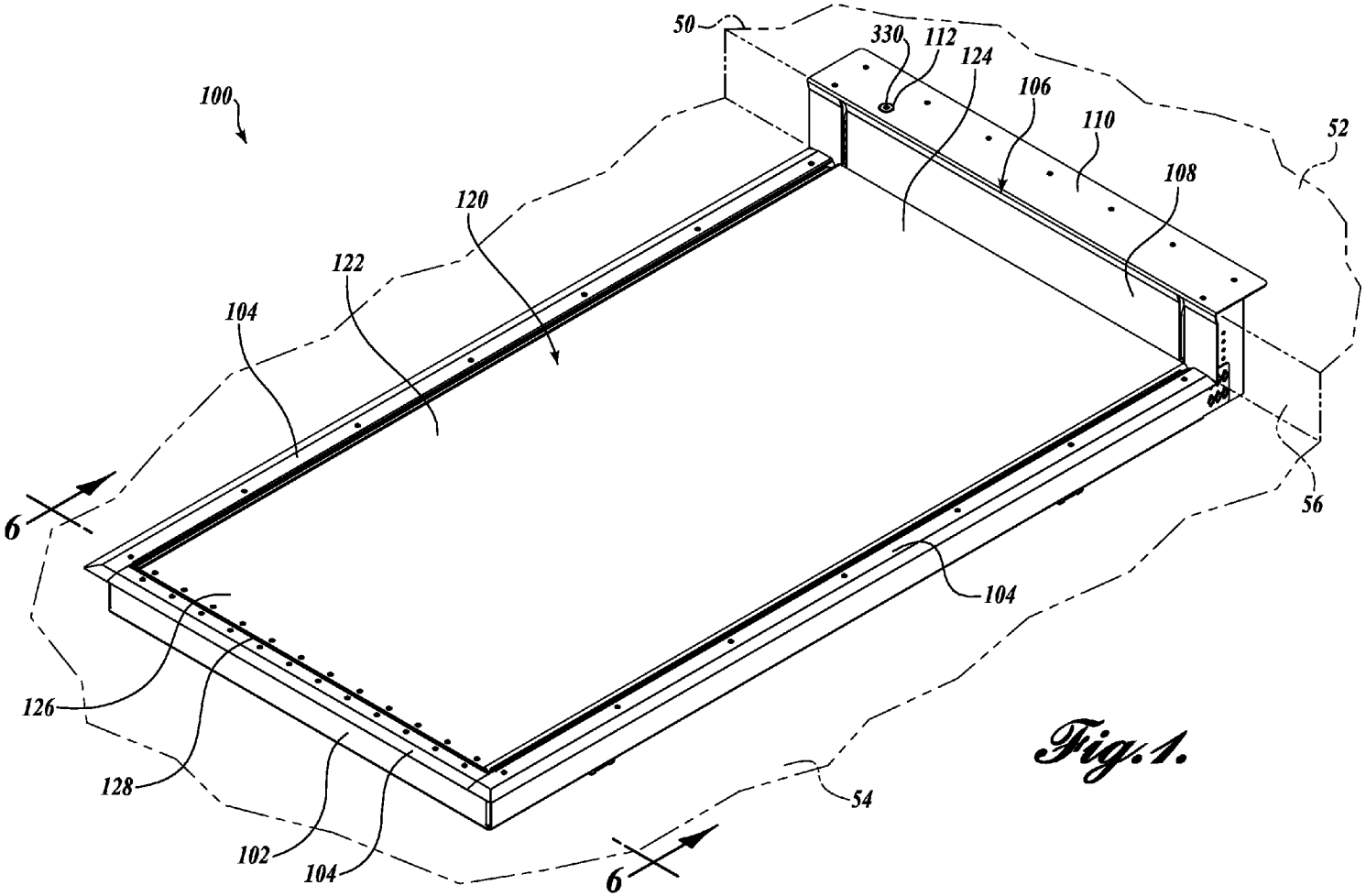
FIG. 1 shows an isometric view of an exemplary embodiment of an operable ramp installed in an architectural setting with the operable ramp in a stowed position.
Figure 2:
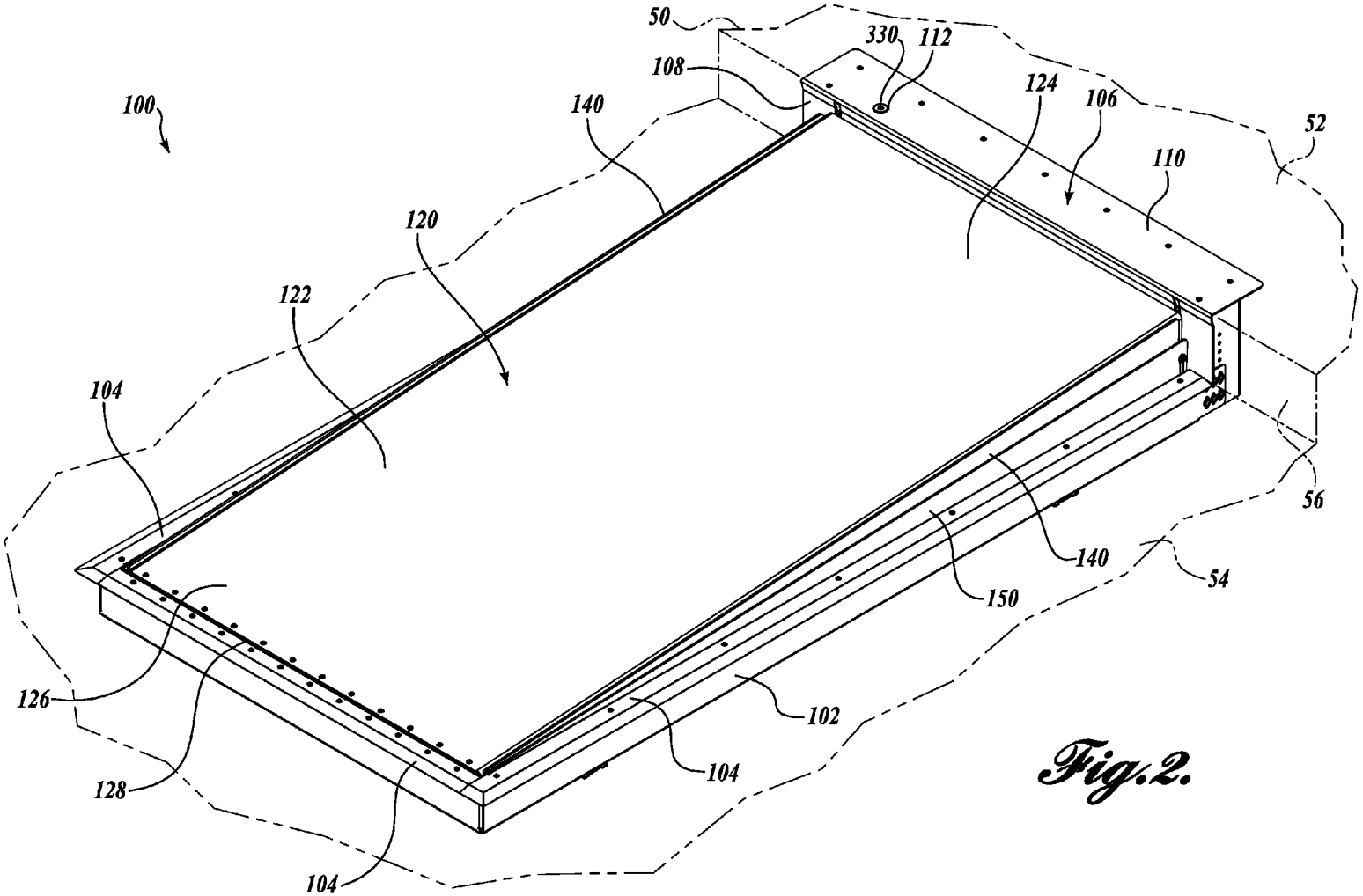
FIG. 2 shows an isometric view of the operable ramp of FIG. 1 between the stowed position and a deployed position.
Figure 3:
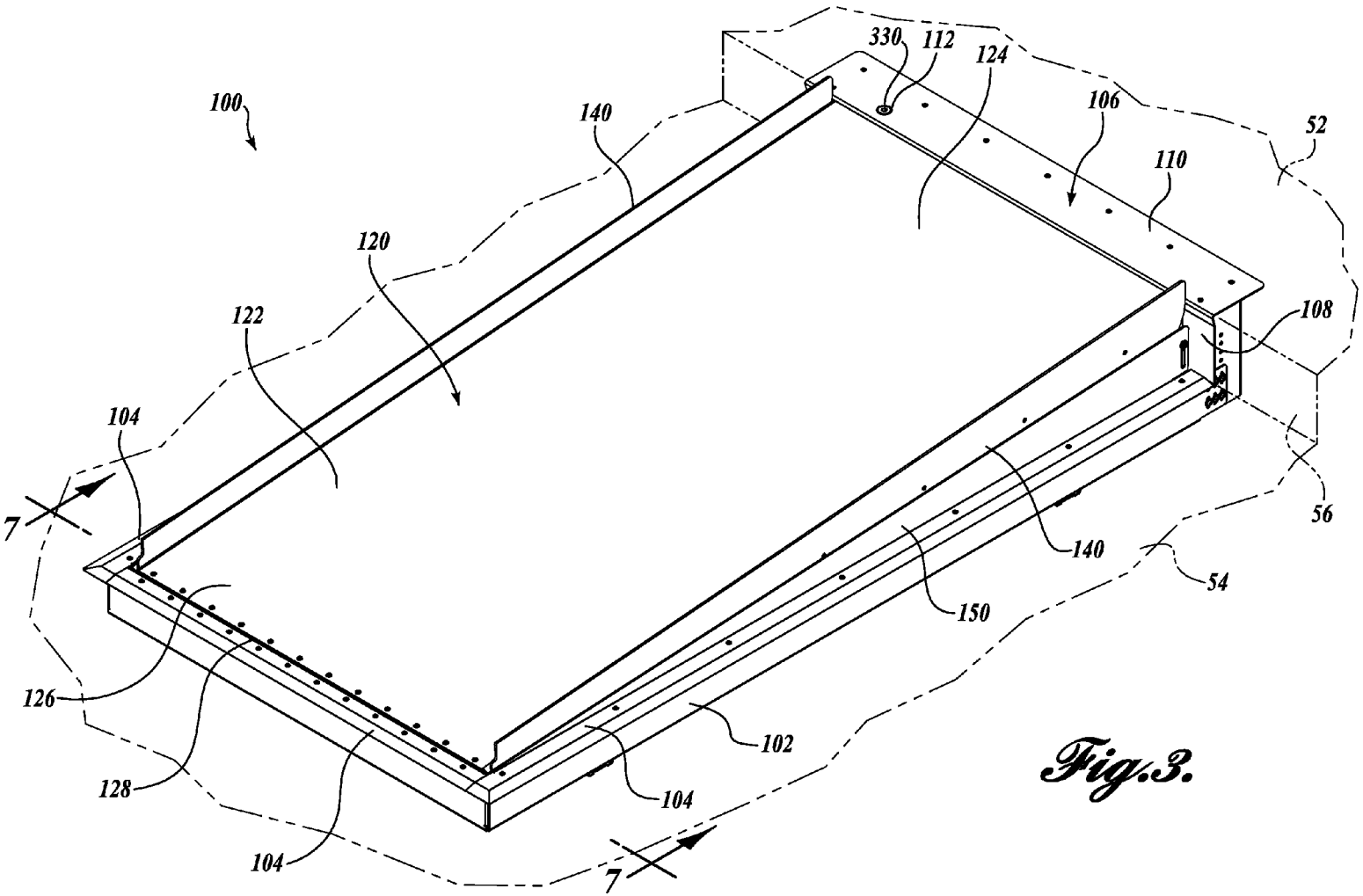
FIG. 3 shows an isometric view of the operable ramp of FIG. 1 in the deployed position.

FIGS. 1-3 show an exemplary embodiment of an operable ramp 100 installed in conjunction with a step 50. The step 50 includes a horizontal first surface 52 located higher than and generally parallel to a lower second surface 54. Like known step configurations, a vertical riser 56 extends between the first and second surfaces 52 and 54.

Referring specifically to FIG. 1, the operable ramp 100 is shown in the stowed position. The operable ramp 100 includes a frame 102 at least partially disposed below the second surface 54. The frame 102 provides a structure with a fixed position to which the components of the operable ramp 100 are attached. To install the operable ramp 100 in conjunction with a step 50, the frame 102 is attached to surrounding portions of the step to secure the operable ramp in place. It will be appreciated that the disclosed operable ramp 100 is not limited to use with a step, but can also be used in various other architectural settings in which a transition surface is required between a first and second surface. Further, although the illustrated embodiments of the operable ramp 100 include a frame 102, other embodiments are contemplated in which the operable ramp 100 does not include a frame. To install such embodiments in conjunction with a step or in other architectural settings, the operable ramp 100 components are attached directly to the surrounding structure or to suitable structure within the building, thus making a frame 102 unnecessary. Accordingly, embodiments of the described operable ramp 100 that do not include a frame 102 should be considered within the scope of the present disclosure.

Still referring to FIG. 1, the operable ramp 100 includes a ramp panel 120 and an inner closeout 106 constructed from well-known materials to have suitable strength and durability. The ramp panel 120 has a rectangular upper surface 122 that is generally flush with the lower second surface 54 when the operable ramp 100 is in the stowed position. One or more trim elements 104 extend laterally from the perimeter of the operable ramp 100 to provide a smooth transition between the upper surface 122 of the ramp panel 120 and the second surface 54. An inner closeout 106 is positioned at the inner end of the ramp panel 120. The inner closeout 106 includes a vertical surface 108 that is generally flush with the riser 56 of the step 50 and a horizontal surface 110 that is generally flush with the upper first surface 52. Thus, as shown in FIG. 1, the upper surface 122 of the ramp panel 120 and the inner closeout 106 cooperate to form part of the step 50 when the operable ramp 100 is in the stowed position.

The operable ramp 100 is selectively moveable from the stowed (step) position of FIG. 1 to the deployed (ramp) position of FIG. 3. To move from the stowed position to the deployed position, the inner end 124 of the ramp panel 120 is raised. Raising the inner end 124 of the ramp panel 120 rotates the ramp about the outer end 126, which is rotatably coupled to the frame 102 by a hinge 128. It will be appreciated that embodiments are contemplated in which configurations other than a hinged attachment to the frame allow the ramp panel 120 to rotate about an axis located at or near the outer end 126 of the ramp panel, and such embodiments should be considered within the scope of the present disclosure.

As the ramp panel 120 moves through the intermediate position of FIG. 2 toward the deployed position of FIG. 3, side curbs 140 are deployed upwardly along the sides of the ramp panel 120. As shown in FIG. 3, the side curbs 140 extend upward along the sides of the ramp panel 120 to provide barriers along the sides of the ramp in order to increase the safety of the operable ramp 100.

When the operable ramp 100 is in the deployed position of FIG. 3, the ramp panel 120 slopes downward from its inner end 124 so that the upper surface 122 of the ramp panel acts as a transition surface that extends from the upper first surface 52 to the lower second surface 54. Side curbs 140 extend along the sides of the ramp panel 120 to prevent a wheelchair user from rolling off the side of the ramp panel. In addition, when the operable ramp is in the deployed position, a side closeout 150 extends downward from each side of the ramp panel 120 to prevent potential pinching conditions by blocking access to the area under the deployed ramp panel. As the operable ramp 100 moves from the deployed position of FIG. 3 back to the stowed position of FIG. 1, the side curbs 140 retract, and the side closeout 150 moves downward with the ramp panel 120.

Figure 4:
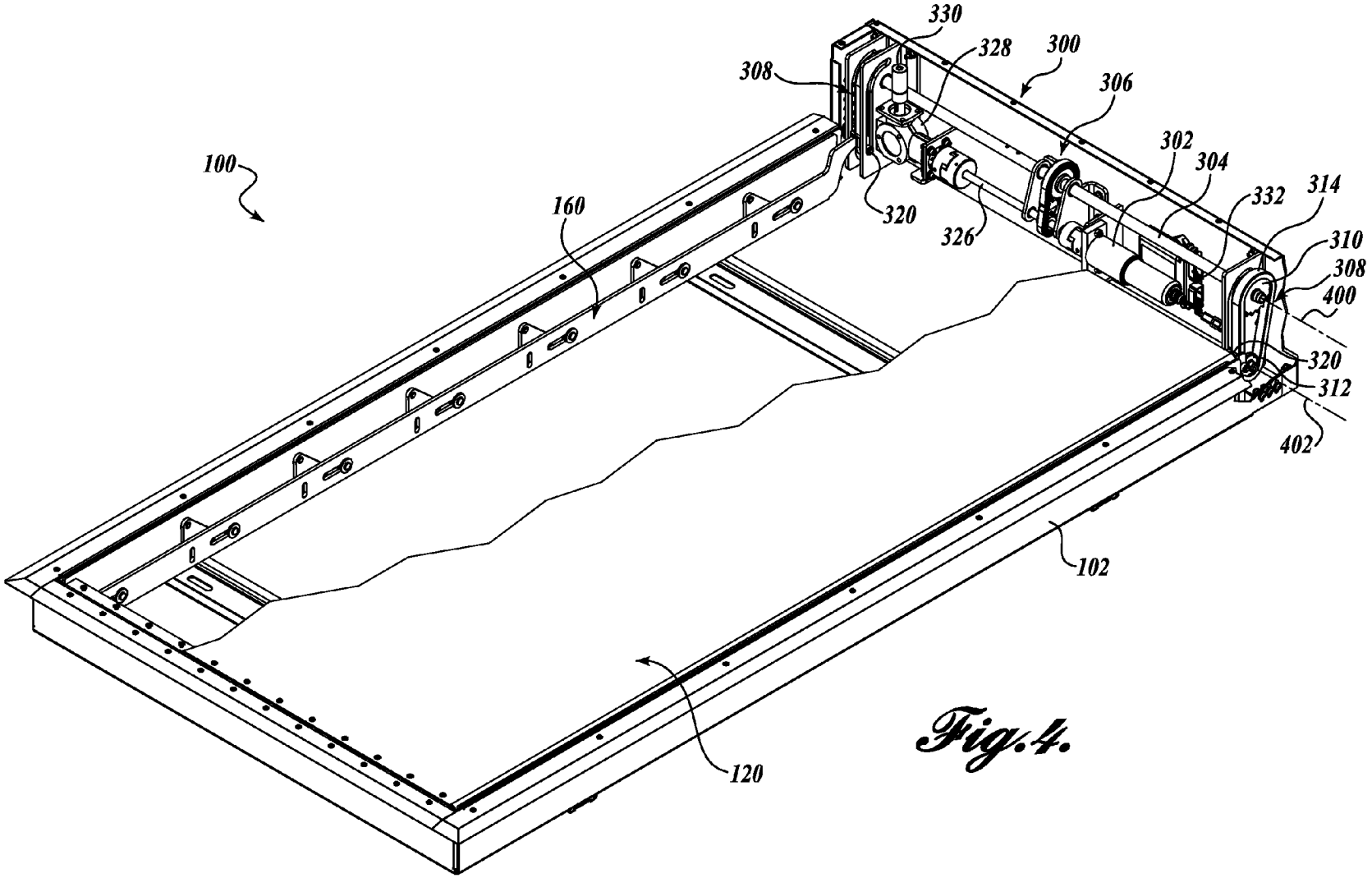
FIG. 4 shows a cutaway isometric view showing a drive assembly of the operable ramp of FIG. 1 with the operable ramp in the stowed position.
Figure 5:
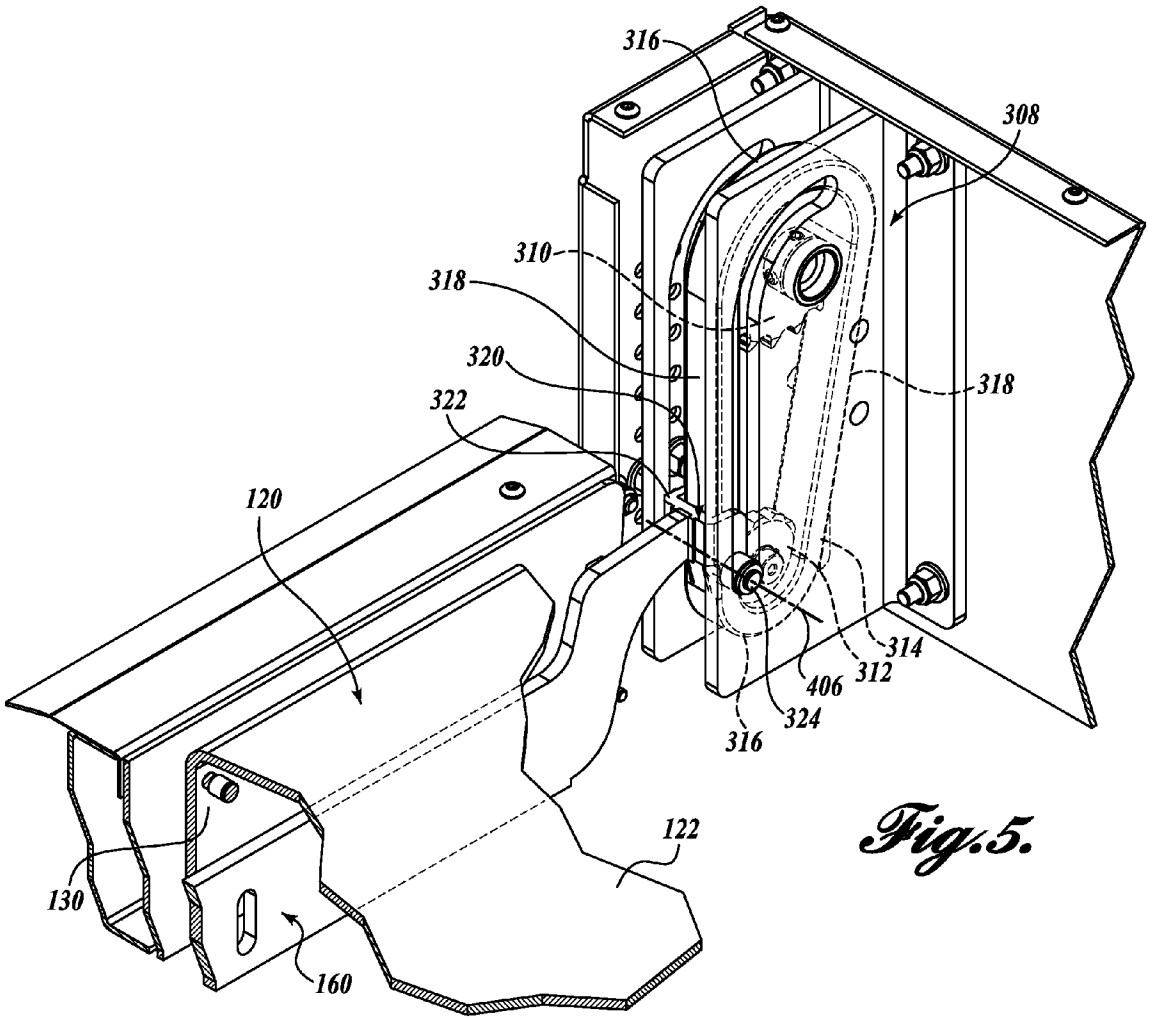
FIG. 5 shows a partial cutaway isometric view of the drive assembly of FIG. 4.

As shown in FIGS. 4 and 5, the operable ramp 100 includes a drive assembly 300 to selectively reciprocate the operable ramp between the stowed position and the deployed position. In the disclosed embodiment, the drive assembly 300 is positioned below the inner closeout 106; however, various embodiments are possible in which all or some of the drive assembly components are located in other positions, and the disclosed exemplary configuration should not be considered limiting in this regard. As best shown in FIG. 4, the drive assembly 300 includes a motor 302 selectively operated by a controller 332. The motor 302 is operably coupled to a drive shaft 304 by a known transmission 306 so that the motor selectively rotates the drive shaft about a fixed axis 400. The drive shaft 304 extends across the width of the operable ramp 100 and is coupled at each end to a chain assembly 308. In the illustrated embodiment, the chain assemblies 308 are similar. Accordingly, one chain assembly 308 will be described with the understanding that the other chain assembly is likewise configured.

Referring now to FIG. 5, the chain assembly 308 includes an upper sprocket 310 and a lower sprocket 312. The upper sprocket 310 is coupled to the drive shaft 304 so that rotation of the drive shaft rotates the upper sprocket about the drive shaft axis 400. The lower sprocket 312 is coupled to the frame 102 or some other fixed structure to be rotatable about an axis 402 that is parallel to the drive shaft axis 400. A chain 314 forms an endless loop that engages the upper and lower sprockets 310 and 312. In the illustrated embodiment, the path of the chain includes two arcuate portions 316, wherein the chain engages the sprockets 310 and 312 and two linear portions 318 separating the arcuate portions. A coupler 320 rotatably couples one end of a support element 160 to the chain 314 so that the end of the support element follows the path of the chain when the chain moves along the endless loop.

In other contemplated configurations, a rotatable drive arm or other suitable linkage is used in place of the chain assembly 308 to move the coupler 320 along a predetermined path. Further, the path of the coupler 320 can vary. In one contemplated embodiment, such as when a rotating drive arm is utilized, the coupler 320 follows an arcuate path through the entire deployment motion. These and other configurations are contemplated and should be considered within the scope of the present disclosure.

In the disclosed embodiment, the coupler 320 includes a clevis 322 rotatably supported by a pin 324 having an axis 406 that extends laterally from the chain 314. In the illustrated embodiment, the clevis 322 rests on the pin 324, allowing the ramp panel 120 to be rotated about the hinge 128 for easy access to the interior of the operable ramp 100; however, it will be appreciated that any number of suitable configurations can be utilized to rotatably couple the support element 160 to the chain assembly 308, and such configurations should be considered within the scope of the present disclosure.

As will be described in further detail, to move the operable ramp 100 from the stowed position to the deployed position, the motor 302 rotates the upper sprocket 310 in a first direction to drive the chain 314 in a first direction along the path of the endless loop, thereby raising the coupler 320 and, thus, the end of the support element 160. To move the operable ramp 100 from the deployed position to the stowed position, the motor 302 rotates the upper sprocket 310 in a second direction opposite the first direction, moving the chain 314 in a second direction along the path of the endless loop to lower the coupler 320 and, therefore, the end of the support element 160.

It will be appreciated that a number of alternate drive assemblies 300 can be utilized to selectively drive the chain 314 in first and second directions along the endless loop. In one alternate embodiment, two motors are utilized, each motor driving one of the chain assemblies 318 to reciprocate the operable ramp between the stowed position and the deployed position. In another alternate embodiment, instead of the disclosed motor with a rotary output, a linear actuator is operably coupled to each support element 160 through a linkage. In yet another possible embodiment, the drive assembly 300 includes a counterbalance to reduce the force required to actuate the operable ramp 100, thereby decreasing the size of the motor. These and other configurations that selectively raise and lower the ends of the support elements 160 are contemplated and should be considered within the scope of the present disclosure.

Referring back to FIG. 4, a secondary shaft 326 is operably coupled to the drive shaft 304 through the transmission 306 such that rotation of the secondary shaft in a first direction rotates the upper sprocket 310 in a first direction, and rotation of the secondary shaft in a second direction rotates the upper sprocket 310 in a second direction. A second end of the secondary shaft 326 is coupled to the output of a gearbox 328. The gearbox 328 includes an upward facing input shaft having a keyway 330, which is accessible from above the inner closeout 106 through an access hole 112, shown in FIGS. 1-3.

In the event of a loss of power or a motor failure, an operator can actuate the operable ramp 100 manually. To do so, the operator inserts a crank through the access hole 112 into the keyway 330 and rotates the crank in a first direction to move the operable ramp 100 toward the deployed position, and in a second direction to move the operable ramp toward the stowed position. It will be appreciated that a number of variations to the illustrated manual deploy mechanism can be incorporated. In this respect, the size, position, and configurations of mechanisms that transfer a manual input into rotation of the drive shaft 304 can vary, and such variations should be considered within the scope of the present disclosure.

Figure 6:
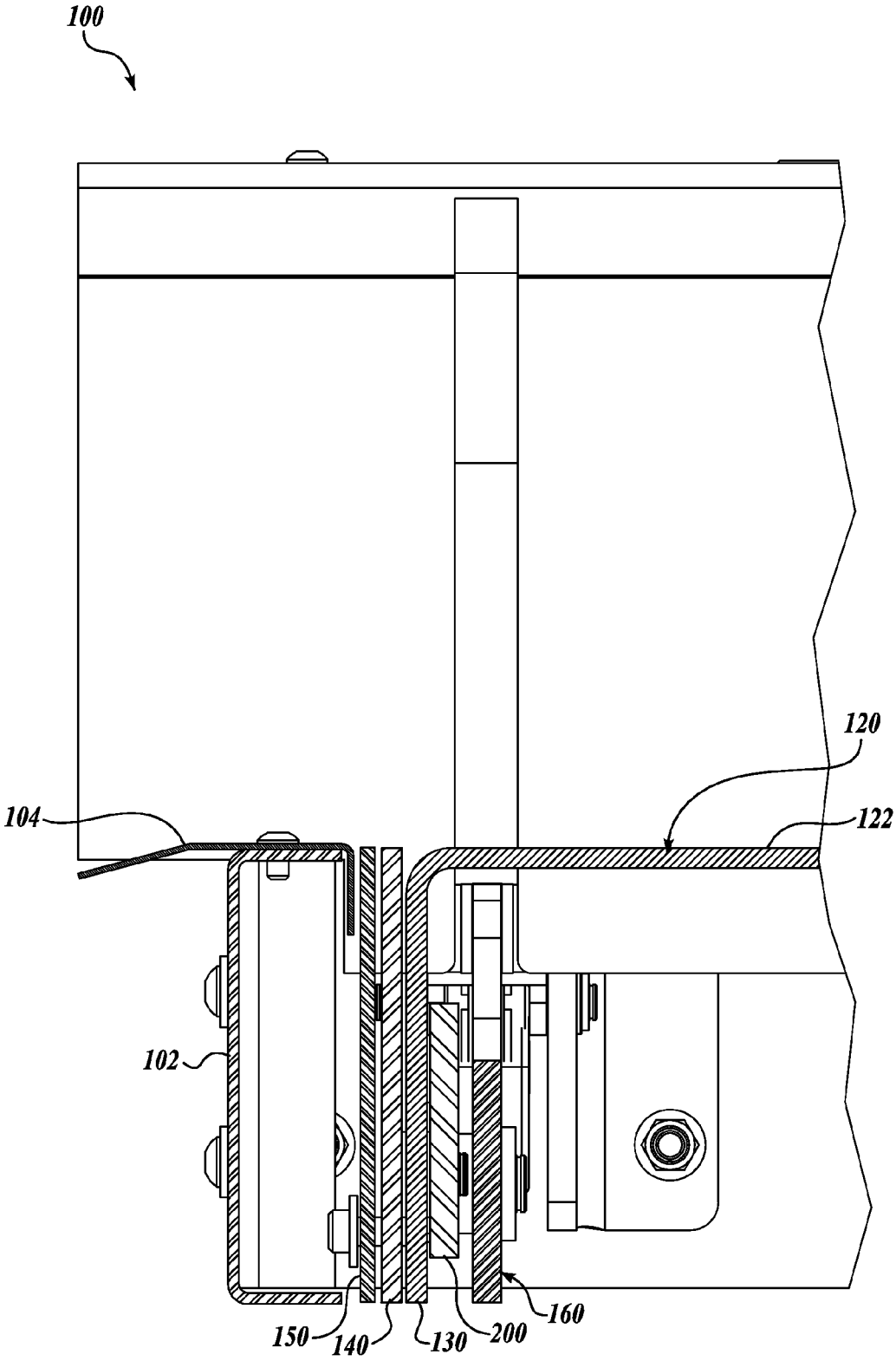
FIG. 6 shows a cross-sectional end view of the operable ramp of FIG. 1 in the stowed position.
Figure 7:
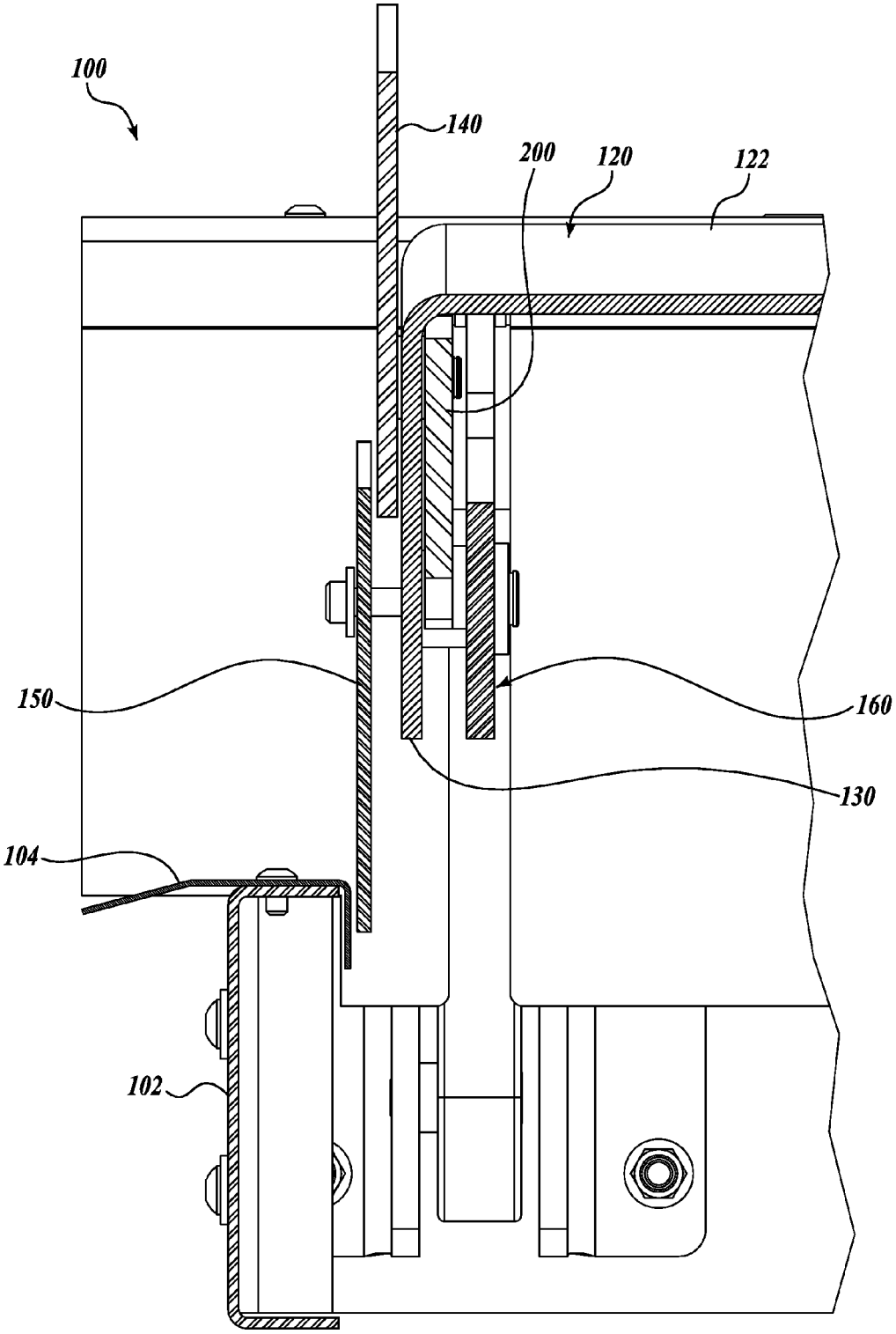
FIG. 7 shows a cross-sectional end view of the operable ramp of FIG. 1 in the deployed position.

Referring now to FIGS. 6 and 7, the ramp panel 120 has a C-shaped cross-section, with a vertical leg 130 extending downward from the upper surface 122 along each side of the ramp panel. Although FIGS. 6 and 7 show one only one side of the ramp panel 120, the other side of the ramp panel and the associated components are a mirror image of FIGS. 6 and 7, or similarly configured. Accordingly, the illustrated side of the ramp panel 120 and associated components are described herein with the understanding that the other side of the ramp panel and the related components operate in a similar manner.

Still referring to FIGS. 6 and 7, a support element 160 is positioned under the ramp panel 120 adjacent to the vertical leg 130. As will be described later, a lifting element 200 is disposed between the vertical leg 130 and the support element 160. A side curb 140 is positioned next to the vertical leg 130 opposite the lifting element 200 and support element 160. A side closeout 150 is positioned next to the side curb 140 so that the side curb is located between the side closeout and the vertical leg 130. As shown in FIG. 6, when the operable ramp 100 is in the stowed position, the upper edges of the side curb 140 and the side closeout 150 are flush with or lower than the upper surface 122 of the ramp panel 120. When the operable ramp 100 is in the deployed position, the side curb 140 extends upward from the ramp panel 120 and the side closeout 150 extends downward from the ramp panel.

Figure 8:
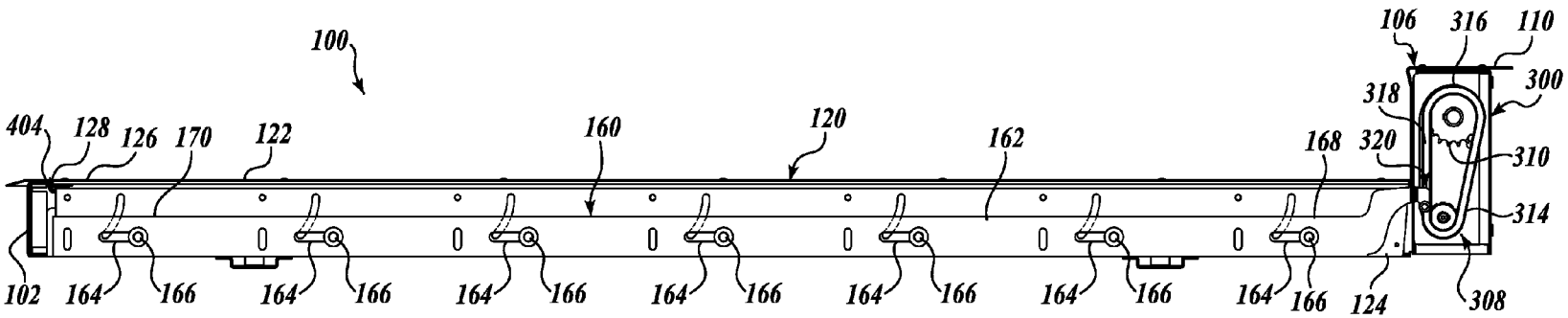
FIG. 8 shows a cross-sectional side view of the operable ramp of FIG. 1, showing a support element with the operable ramp in the stowed position.
Figure 9:
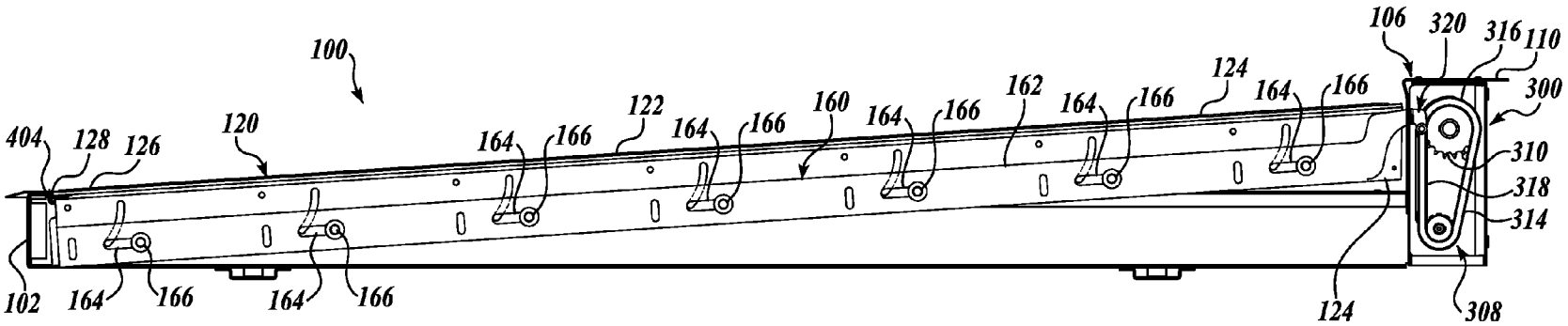
FIG. 9 shows a cross-sectional side view of the operable ramp of FIG. 8, showing the support element with the operable ramp between the stowed position and the deployed position.
Figure 10:
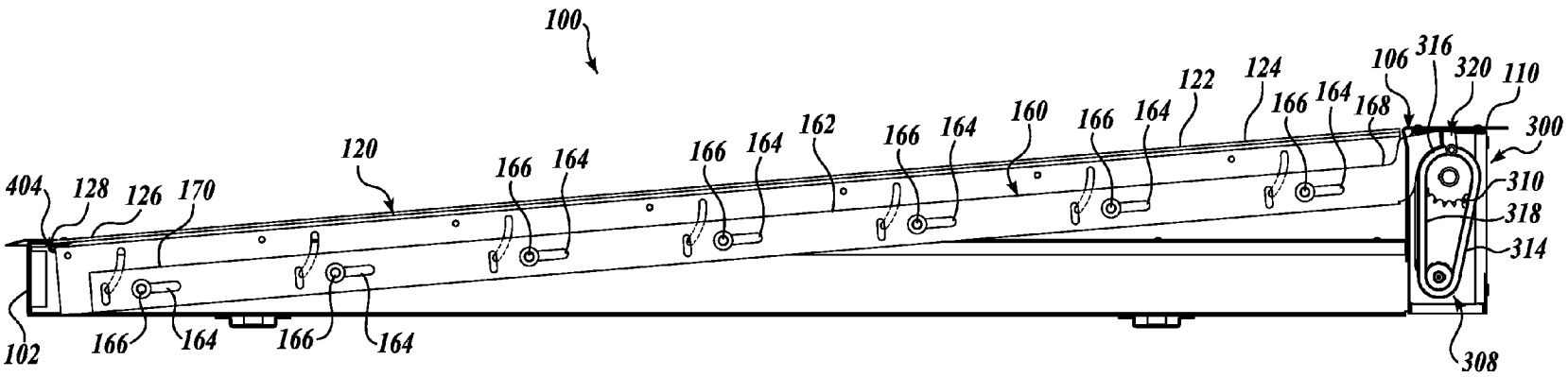
FIG. 10 shows a cross-sectional side view of the operable ramp of FIG. 9, showing the support element with the operable ramp in the deployed position.

Referring now to FIGS. 8-10, the support element 160 is associated with the drive assembly 300 to selectively raise and lower the ramp panel 120. The support element 160 has an elongate body 162 that extends at least part of the length of the ramp panel 120. A plurality of spaced apart horizontal slots 164 are formed in the body 162 to enable the support element 160 to be slidingly coupled to the ramp panel 120. In this regard, a plurality of bearing elements 166 are coupled to the vertical leg 130 of the ramp panel 120 and extend inwardly, each bearing element extending through one of the horizontal slots. Thus, the support element 160, which is coupled to the ramp panel 120 by the engagement of the horizontal slots 164 with the bearing elements 166, is capable of sliding relative to the ramp panel 120, as shown in FIGS. 8-10. It will be appreciated that the support element 160 may be slidingly coupled to the ramp portion 120 utilizing any suitable configuration that allows relative motion between the support element and the ramp portion, and such configurations should be considered within the scope of the present disclosure.

As previously described, the outer end 126 of the ramp panel 120 is hingedly coupled to the frame 102 by a hinge 128 to be rotatable about hinge axis 404. Thus, the hinge 128 supports the outer end 126 of the ramp panel 120, which in turn supports the support element 160, so that both the ramp panel and the support element are rotatable about axis 404.

As previously described, the coupler 320 disposed on the inner end 168 of the support element 160 engages the chain assembly 308 so that the chain assembly both supports and selectively positions the inner end of the support element. Because the support element 160 is slidably coupled to the ramp panel 120, the chain assembly 308 also supports and selectively positions the inner end 124 of the ramp panel.

When the operable ramp 100 is in the stowed position of FIG. 8, the ramp panel 120 is supported in a generally horizontal position by the hinge 128 and the chain assembly 308 via the coupler 320. When the operable ramp 100 is so positioned, the coupler is located along a linear portion 318 of the chain 314.

To move the operable ramp 100 through a first phase of deployment, the motor 302 rotates the upper sprocket 310 (the drive sprocket) in a clockwise direction as viewed in FIGS. 8 and 9. Rotation of the upper sprocket 310 in a clockwise direction moves the chain 314 and, therefore, the coupler 320, along the path of the endless loop formed by the chain. During the first deployment phase, the coupler 320 moves upward along a linear portion 318 of the chain assembly 308, thereby raising the outer end 168 of the support element 160 and rotating the ramp panel 120 upward about its outer end 126. In the illustrated embodiment, the linear portion 318 of the chain assembly 308 is positioned to be approximately vertical. Accordingly, only minor relative motion occurs between the ramp panel 120 and the support element 160 as the inner end 168 of the support element is raised.

The first deployment phase ends when the coupler 320 reaches the upper end of the linear portion 318 of the chain 314, as shown in FIG. 9. From this intermediate position, further rotation of the upper sprocket 310 in a clockwise direction as viewed in FIG. 9 drives the operable ramp 100 through a second deployment phase until the operable ramp reaches the deployed position of FIG. 10. As the chain 314 continues to move in a clockwise direction (as viewed in FIGS. 9 and 10) along the path of the endless loop, the coupler 320 moves along an arcuate portion 316 of the chain. That is, the coupler 320 moves upward as well as inward. The upward motion of the coupler 320 continues to raise the inner end 124 of the ramp panel 120 until the end of the ramp panel is aligned with the horizontal surface 110 of the inner closeout 106, i.e., until the ramp panel is positioned to provide a transition surface between the upper first surface 52 and lower second surface 54.

As the operable ramp 100 moves through the second deployment phase, the inward movement of the coupler 320 slides the support element 160 relative to the ramp panel 120. More specifically, the outer end 126 of the ramp panel 120 maintains a fixed distance from axis 404, while the inner end 168 of the support element 160 moves inwardly with the coupler.

To move the operable ramp 100 from the deployed position of FIG. 10 to the stowed position of FIG. 8, the motor 302 rotates the upper sprocket 310 in a counterclockwise direction as viewed in FIGS. 8-10 to drive the chain 314 in the counterclockwise direction along the path of the endless loop. As the operable ramp 100 moves from the deployed position of FIG. 10 to the intermediate position of FIG. 9, the coupler 320 moves downward and outward along the arcuate portion 316 of the chain 314. Movement along the arcuate portion 316 of the chain 314 lowers the inner end 124 of the ramp portion 120 and moves the support element 160 outward relative to the ramp panel.

As the operable ramp 100 moves from the intermediate position toward the stowed position, the coupler 320 enters the linear portion 318 of the chain 314. From there, the coupler 320 moves downward along the linear portion 318 of the chain 314, which moves the inner end 124 of the ramp panel 120 downward until the operable ramp 100 has reached the stowed position of FIG. 8. As the coupler 320 moves downward along the linear portion 318 of the chain 314, relative motion between the ramp panel 120 and the support element 160 is minimal.

Figure 11:
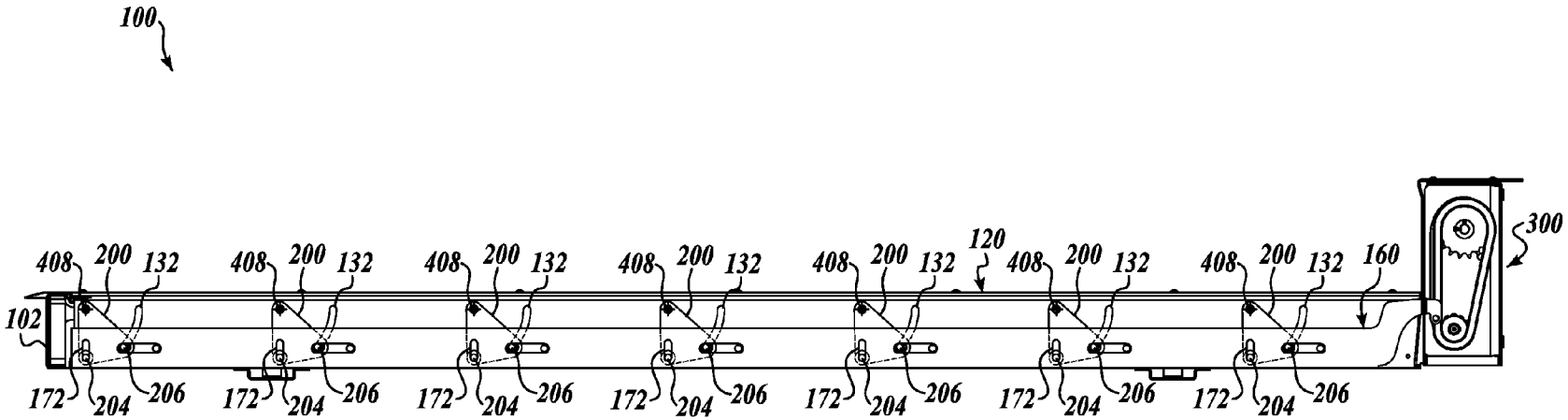
FIG. 11 shows a cross-sectional side view of the operable ramp of FIG. 1, showing a side curb with the operable ramp in the stowed position.
Figure 12:
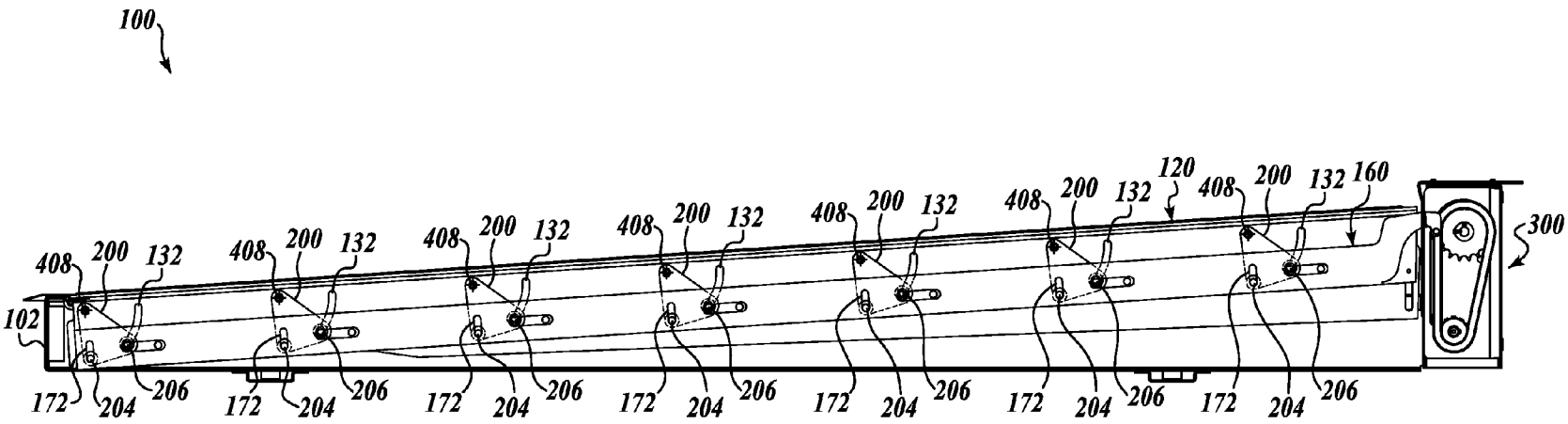
FIG. 12 shows a cross-sectional side view of the operable ramp of FIG. 11, showing the side curb with the operable ramp between the stowed position and the deployed position.
Figure 13:
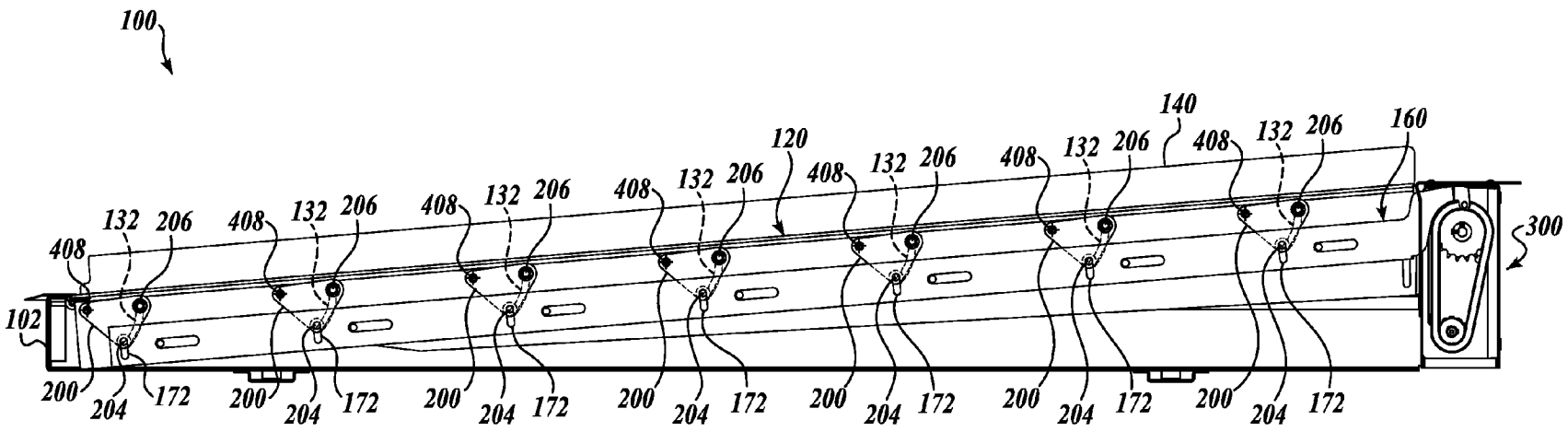
FIG. 13 shows a cross-sectional side view of the operable ramp of FIG. 12, showing the side curb with the operable ramp in the deployed position.

Referring now to FIGS. 11-13, actuation of the side curb 140 will be described. A plurality of lifting elements 200 are rotatably coupled to the inside surface of each vertical leg 130 of the ramp panel 120 about an axis 408. As shown in FIGS. 6 and 7, each lifting element 200 is disposed between the support element 160 and the vertical leg 130 of the ramp panel 120. In the illustrated embodiment, each lifting element 200 has a generally triangular profile and is formed from metal sheet or plate; however, other suitable shapes and material are possible within the scope of the present disclosure.

Referring back to FIGS. 11-13, a vertical slot 172 is formed in the support element 160 at each lifting element 200. A bearing element 204 extends from each lifting element 200 to slidingly engage the corresponding vertical slot 172. As best shown in FIGS. 12 and 13, when the support element 160 moves relative to the vertical leg 130 of the ramp panel 120, each bearing element 204 cooperates with the corresponding vertical slot 172 to rotate the lifting element 200 about axis 408.

A pin 206 extends laterally from each lifting element 200 through the vertical leg 130 of the ramp panel 120 to rotatably couple the lifting element to the side curb 140. The pin 206 is rotatably coupled to the lifting element 200, the side curb 140, or both to allow for rotation of the lifting element relative to the side curb. The pins 206 support the side curb 140 so that rotation of the lifting elements 200 in a first direction raises the side curb relative to the ramp panel 120, and rotation of the lifting elements 200 in a second direction lowers the side curb relative to the ramp panel.

Each pin 206 corresponds to an arcuate slot 132 formed in the vertical leg 130 of the ramp panel 120. The arcuate slot 132 corresponds to the path of the pin 206 when the lifting element 200 rotates about axis 408. The arcuate slot 132 is sized to be larger than the diameter of the pin 206 so that the pin travels unimpeded along the slot when the lifting element 200 rotates in response to relative motion between the support element 160 and the ramp panel 120.

As the operable ramp 100 moves from the stowed position of FIG. 11 to the intermediate position of FIG. 12, there is little to no relative movement between the support element 160 and the vertical leg 130 of the ramp panel 120. As a result, rotation of the lifting elements 200 about axes 408 is negligible. As the operable ramp 100 moves from the intermediate position of FIG. 12 to the deployed position of FIG. 13, the support element 160 moves relative to the vertical leg 130 of the ramp panel 120 to rotate the lifting elements 200 in a counterclockwise direction as viewed in FIGS. 11-13. Rotation of the lifting elements 200 drives the pins 206 upward along the arcuate slots 132 to raise the side curb 140 to the deployed position of FIG. 13.

When the operable ramp 100 moves from the deployed position of FIG. 13 to the intermediate position of FIG. 12, the movement of the support element 160 relative to the vertical leg 130 of the ramp panel 120 rotates the lifting elements 200 in the clockwise direction as viewed in FIGS. 11-13. Rotation of the lifting elements 200 in the clockwise direction retracts the side curb 140 to a position below the upper surface 122 of the ramp panel. In the illustrated embodiment, when the operable ramp 100 moves from the intermediate position of FIG. 12 to the stowed position of FIG. 11, there is little to no relative movement between the support element 160 and the vertical leg 130 of the ramp panel 120, so rotation of the lifting elements 200 about axes 408 is negligible.

In the illustrated embodiment, the side curbs 140 are generally stowed when the operable ramp 100 is between the intermediate position and the stowed position. That is, relative motion between the support element 160 relative to the vertical leg 130 of the ramp panel 120 is negligible when the operable ramp moves between the intermediate position and the stowed position. It should be appreciated, however, that other configurations are possible such that the side curbs 140 deploy throughout the entire deployment motion or through a different part of the deployment motion. For example, in one exemplary alternate embodiment, the chain assembly 308 is configured such that coupler 320 moves along an angled path to impart relative motion between the support element 160 and the vertical leg 130 of the ramp panel 120 throughout the motion of the ramp. In another contemplated embodiment, the chain assembly 308 is configured to impart relative motion between the support element 160 and the vertical leg 130 of the ramp panel 120 during the first phase of deployment and then limiting the relative motion during a second phase. For such a configuration, the side curbs would deploy immediately upon starting of the deployment motion. These and other configurations for providing different timing of the side curb deployment are contemplated and should be considered within the scope of the present disclosure.

Figure 14:
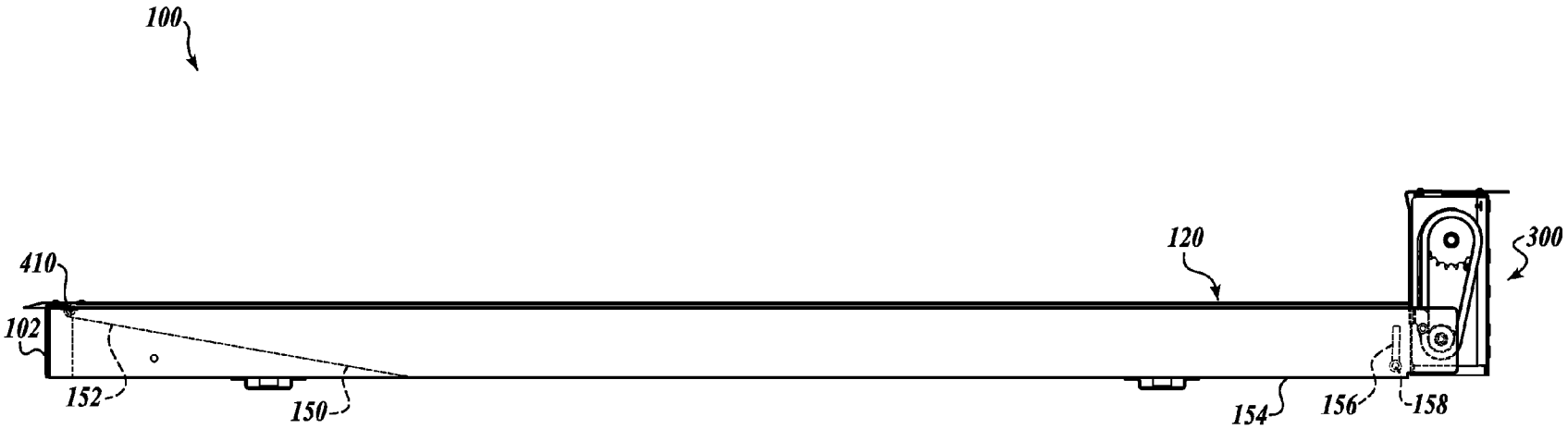
FIG. 14 shows a side view of the operable ramp of FIG. 1, showing a side closeout with the operable ramp in the stowed position.
Figure 15:
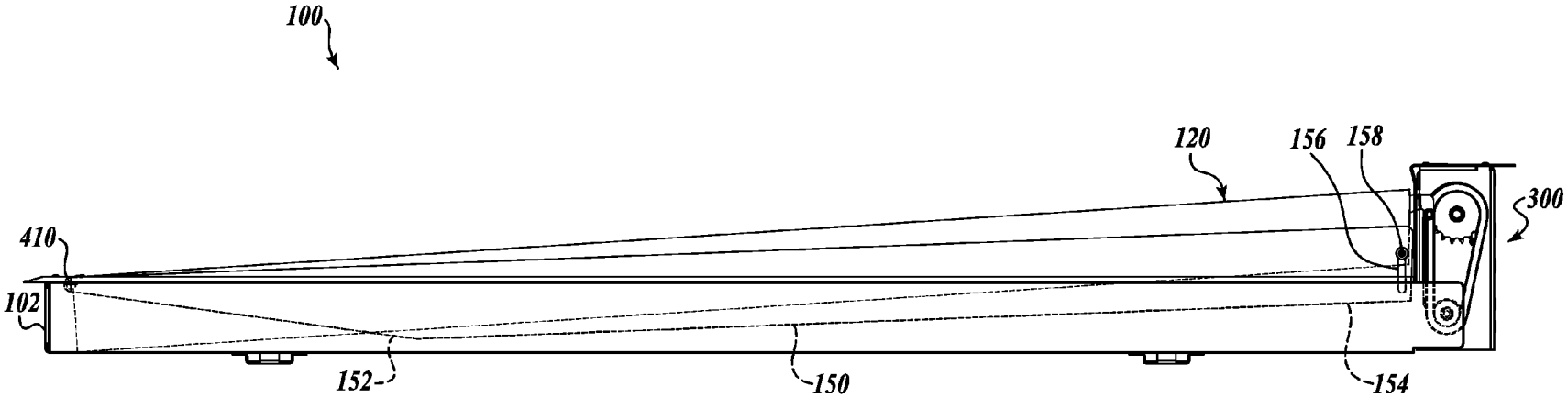
FIG. 15 shows a side view of the operable ramp of FIG. 14, showing the side closeout with the operable ramp in between the stowed position and the deployed position.
Figure 16:
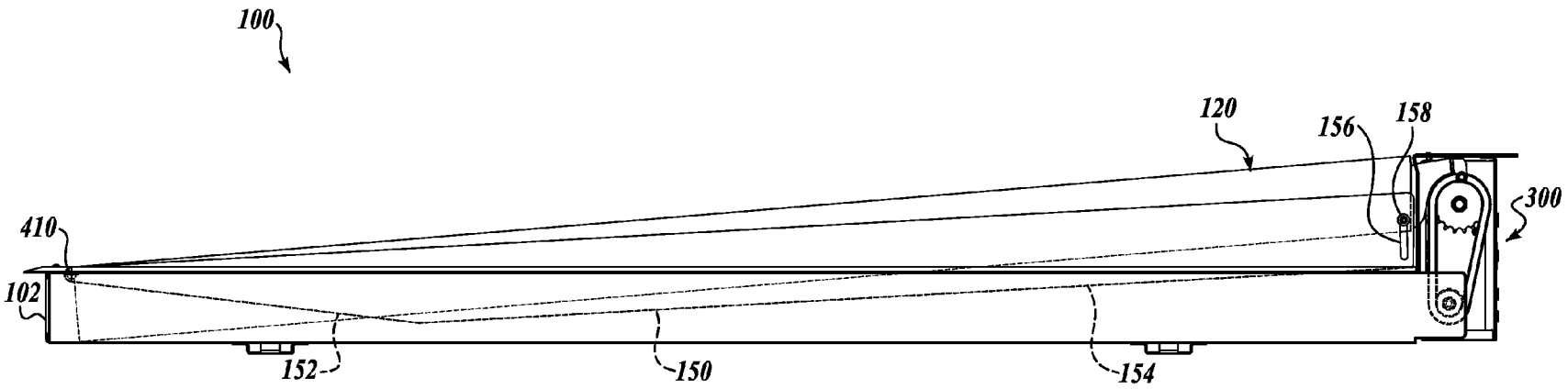
FIG. 16 shows a side view of the operable ramp of FIG. 15, showing the side closeout with the operable ramp in the deployed position.

Referring now to FIGS. 14-16, a side closeout 150 extends down from the ramp panel 120 to eliminate a potential "pinch point" under the ramp panel when the operable ramp is in the deployed position. As shown in FIGS. 6 and 7, the side closeout 150 is positioned adjacent and generally parallel to the side curb 140. A first end 152 of the side closeout is rotatably coupled to the frame 102 about an axis 410. In the illustrated embodiment, axis 410 is coincident with the axis 404 of the hinge 128; however, it is not necessary that axes 410 and 404 be so positioned. Moreover, the side closeout 150 is not limited to being rotatably coupled to the frame 102, but can be rotatably coupled to other suitable structure, such as the ramp panel 120, for example.

A second end 154 of the side closeout 150 includes an elongate slot 156. A bearing element 158 extends laterally from the vertical leg 130 of the ramp panel 120 to engage the slot 156. When the operable ramp is in the stowed position of FIG. 14, the side closeout is beside the side curb 140 and below or flush with the upper surface 122 of the ramp panel 120, as shown in FIG. 6. As the operable ramp 100 moves through the deployment motion, the ramp panel 120 rotates about axis 404, and the bearing element 158 moves upward along the slot 156. When the bearing element 158 reaches the upper end of the slot 156, continued rotation of the ramp panel 120 lifts the second end 154 of the side closeout 150 so that the side closeout rotates about axis 410. Thus, the upper edge of the side closeout 150 follows the vertical leg 130 of the ramp panel 120 as the operable ramp 100 moves to the deployed position of FIG. 16. When in the deployed position, the side closeout 150 extends below the ramp panel 120 to block access to a gap under the ramp panel 120 that would otherwise be accessible.

When the operable ramp 100 moves from the deployed position of FIG. 16 to the stowed position of FIG. 14, the side closeout 150, which is supported by the bearing element 158 and the hinged connection at axis 410, initially moves down with the ramp panel 120. During the movement toward the stowed position, the side closeout 150 contacts a lower portion of the frame or some other suitable structure that engages the side closeout such that further rotation of the ramp panel 120 moves the bearing element 158 downward along the slot 156 while the side closeout maintains a fixed position. The ramp panel 120 continues to move downward until the operable ramp 100 reaches the stowed position of FIG. 14.

While illustrative embodiments have been illustrated and described, it will be appreciated that various changes can be made therein without departing from the spirit and scope of the invention.

The embodiments of the invention in which an exclusive property or privilege is claimed are defined as follows:

1. An operable ramp moveable between a lowered stowed position and a raised deployed position, the operable ramp comprising:

(a) a ramp panel rotatable about a first axis located at a first end of the ramp panel;

(b) a support element slidingly coupled to the ramp panel;

(c) a drive assembly coupled to the support element to selectively raise one end of the support element to rotate the ramp panel about the first axis, wherein raising the one end of the support element moves the support element in a first direction relative to the ramp panel; and (d) a side curb slidingly positioned next to the ramp panel and operatively coupled to the support element, wherein movement of the support element in the first direction relative to the ramp panel moves the side curb upward relative to the ramp panel.

2. The operable ramp of claim 1, further comprising a lifting element rotatably coupled to the ramp panel about a second axis and operably coupled to the side curb and to the support element, wherein movement of the support element relative to the ramp panel rotates the lifting element about the second axis.

3. The operable ramp of claim 2, wherein rotation of the lifting element raises the side curb.

4. The operable ramp of claim 3, wherein the lifting element is slidingly coupled to support element.

5. The operable ramp of claim 4, wherein the lifting element is rotatably coupled to the side curb.

6. The operable ramp of claim 5, further comprising a bearing element rotatably coupling the lifting element to the side curb.

7. The operable ramp of claim 6, wherein the bearing element extends through an arcuate slot formed in the ramp panel.

8. The operable ramp of claim 1, further comprising a closeout rotatable about a first end, a second end of the closeout being slidingly coupled to the ramp panel.

9. The operable ramp of claim 8, wherein the closeout comprises a slot engaging a bearing element that extends from the ramp panel.

10. The operable ramp of claim 9, wherein the bearing element travels upward along the slot when the operable ramp moves from the stowed position to the deployed position.

11. The operable ramp of claim 9, wherein the bearing element engages an upper portion of the slot to lift the closeout when the operable ramp moves from the stowed position to the deployed position.

* * * * *